US008016634B2

(12) United States Patent
Douglas et al.

(10) Patent No.: US 8,016,634 B2
(45) Date of Patent: Sep. 13, 2011

(54) CHILDREN'S LEARNING DEVICE WITH COUNTDOWN TIMER

(75) Inventors: Courtney M. Douglas, Los Angeles, CA (US); Christine D. Thompson, Los Angeles, CA (US)

(73) Assignee: Douglas Thompson Enterprises, LLC, Los Angeles, CA (US)

( * ) Notice: Subject to any disclaimer, the term of this patent is extended or adjusted under 35 U.S.C. 154(b) by 347 days.

(21) Appl. No.: 12/334,363

(22) Filed: Dec. 12, 2008

(65) Prior Publication Data

US 2009/0156090 A1 Jun. 18, 2009

Related U.S. Application Data

(60) Provisional application No. 61/013,987, filed on Dec. 14, 2007.

(51) Int. Cl.

| | |
|---|---|
| ***A63H 33/00*** | (2006.01) |
| ***A63H 3/28*** | (2006.01) |
| ***A63H 3/20*** | (2006.01) |
| ***A63H 11/00*** | (2006.01) |
| ***A63H 29/00*** | (2006.01) |

(52) U.S. Cl. ..... 446/71; 446/72; 446/298; 446/330; 446/484

(58) Field of Classification Search ..... 446/7, 72, 446/81, 268, 297, 298, 300, 303, 330, 376, 446/397, 484, 485, 71; 368/10, 107–109
See application file for complete search history.

(56) References Cited

U.S. PATENT DOCUMENTS

| | | | | |
|---|---|---|---|---|
| 3,747,330 | A | 7/1973 | Tupone | |
| 3,994,078 | A | 11/1976 | Liu | |
| 4,530,607 | A * | 7/1985 | Bungener | 368/109 |
| 4,742,500 | A * | 5/1988 | Luce | 368/10 |
| 5,044,961 | A | 9/1991 | Bruskewitz | |
| 5,058,086 | A * | 10/1991 | Barlow | 368/98 |
| 5,133,666 | A | 7/1992 | Levy | |
| 5,681,040 | A * | 10/1997 | Peterson | 273/148 R |
| 5,684,758 | A * | 11/1997 | Gray et al. | 368/10 |
| 5,872,746 | A | 2/1999 | Reiner et al. | |
| 6,135,845 | A | 10/2000 | Klimpert et al. | |

(Continued)

FOREIGN PATENT DOCUMENTS

EP 831382 A2 * 3/1998

(Continued)

OTHER PUBLICATIONS

Penguin Tea Timer, signals.com, Jun. 19, 2007.

(Continued)

*Primary Examiner* — Alvin Hunter
*Assistant Examiner* — Alyssa Hylinski

(57) ABSTRACT

A child's learning device includes a housing, a countdown timer and a driving mechanism. The housing includes a main body and an appendage attached to the main body, the appendage pivoting between a first orientation and a second orientation. The countdown timer includes a control mechanism for designating one of a plurality of designated time periods. The driving mechanism is connected between the countdown timer and the appendage. The driving mechanism and countdown timer are configured such that manually pivoting the appendage from the first orientation to the second orientation sets the countdown timer for the designated time period, and the appendage is driven back from the second orientation to the first orientation over the course of the designated time period by mechanical force provided by countdown timer to the driving mechanism.

21 Claims, 2 Drawing Sheets

U.S. PATENT DOCUMENTS

| | | | | |
|---|---|---|---|---|
| 6,478,583 | B1 | 11/2002 | Standiford et al. | |
| 6,614,727 | B2 | 9/2003 | McGuire | |
| 6,769,952 | B1 | 8/2004 | Drosendahl et al. | |
| 6,962,494 | B1 | 11/2005 | Olson | |
| 7,298,284 | B2 * | 11/2007 | Glime | 340/691.1 |
| 7,484,882 | B2 * | 2/2009 | Bhavnani | 368/98 |
| 2003/0179653 | A1 * | 9/2003 | McLemore et al. | 368/10 |
| 2005/0249048 | A1 | 11/2005 | Lothrop et al. | |
| 2006/0133215 | A1 * | 6/2006 | Gordon et al. | 368/79 |

FOREIGN PATENT DOCUMENTS

| | | |
|---|---|---|
| WO | WO9601444 | 1/1996 |

OTHER PUBLICATIONS

Time Tracker Visual Timer & Clock, learningresources.com, Jun. 19, 2007.

* cited by examiner

CHILDREN'S LEARNING DEVICE WITH COUNTDOWN TIMER

CROSS REFERENCE TO RELATED APPLICATIONS

This application claims the benefit of U.S. Provisional Application No. 61/013,987 filed on Dec. 14, 2007, the entirety of which is incorporated herein by reference.

BACKGROUND

Generally speaking, "time out" timers for children provide a means disciplining children by delineating intervals of time in which certain activities are proscribed. For example, U.S. Pat. No. 5,684,758 describes a child disciplinary device comprising a plush toy having a timer attached thereto. When a child is given a "time out" by the parent, i.e., removed from a situation of undesired activity and made to reflect on his or her actions, the timer is set for an appropriate period of time and the device handed to the child. The diversion of such a device may reduce a child's idleness during the "time out."

In U.S. Pat. No. 5,684,758, the timer comprises a face member having indications corresponding minutes or ages. A timing hand is rotated clockwise to set the timer, and rotates counterclockwise to indicate elapsed time. However, time is an abstract concept that is difficult for young children to understand. In particular, the use of the rotation of a clock hand to indicate the passage of time is often too abstract for younger children. Furthermore, as younger children do not have the physical dexterity to manipulate a clock hand, it is the parent who must set the timer. This limits the child to a purely passive role in the implementation of the timer, which lessens its educational value.

SUMMARY

It is therefore an object of the present invention to provide a learning device for teaching children to share and take turns. It is another object of the present invention to provide a learning device with a countdown timer in which visual cues that are easily grasped by young children are used to represent the passage of time.

An embodiment of the child's learning device of the present invention comprises a housing, a countdown timer and a driving mechanism. The housing comprises a main body and an appendage attached to the main body, the appendage pivoting between a first orientation and a second orientation. The countdown timer comprises a control mechanism for designating one of a plurality of predetermined time periods. The driving mechanism is connected between the countdown timer and the appendage, wherein the driving mechanism and the countdown timer are configured such that manually pivoting the appendage from the first orientation to the second orientation sets the countdown timer for the designated time period, and the appendage is driven back from the second orientation to the first orientation over the course of the designated time period by mechanical force provided by countdown timer to the driving mechanism.

In one preferred embodiment of the present invention, the countdown timer comprises a mechanical timer configured such that unwinding of the mechanical timer applies mechanical force to the driving mechanism to drive the appendage from the second orientation to the first orientation. In another preferred embodiment, the countdown timer comprises a digital timer operating together with an electrical geared motor, wherein the electrical geared motor is configured to apply mechanical force to the driving mechanism to drive the appendage from the second orientation to the first orientation.

In a preferred embodiment, the learning device further comprises a sound chip, a speaker, and a switch assembly connected to the countdown timer, wherein the switch assembly is configured to activate the sound chip to output audio content via the speaker during the unwinding of the countdown timer. In this embodiment, a memory in which the audio content is stored may also be provided. The audio content preferably includes a song about sharing. In preferred embodiments, the audio content further includes a termination message, and the switch assembly is further configured to output the termination message when the appendage returns to the first orientation from the second orientation.

In a most preferred embodiment of the present invention, a light-emitting device is disposed at a distal end of the appendage. The light-emitting device is configured to be activated by the return of the appendage to the first orientation from the second orientation.

The main body preferably comprises a base suitable for supporting the device in an upright position. Preferably, the first orientation is raised and the second orientation is lowered relative to the upright position. In a most preferred embodiment of the present invention, the main body has the shape of an animal, and the appendage has the shape of an animal appendage. In other preferred embodiments, the main body has the shape of a cartoon character.

BRIEF DESCRIPTION OF THE DRAWINGS

These and other features, aspects, and advantages of the present invention will become better understood with regard to the following description, appended claims, and accompanying drawings, where:

DESCRIPTION

Figure 1:
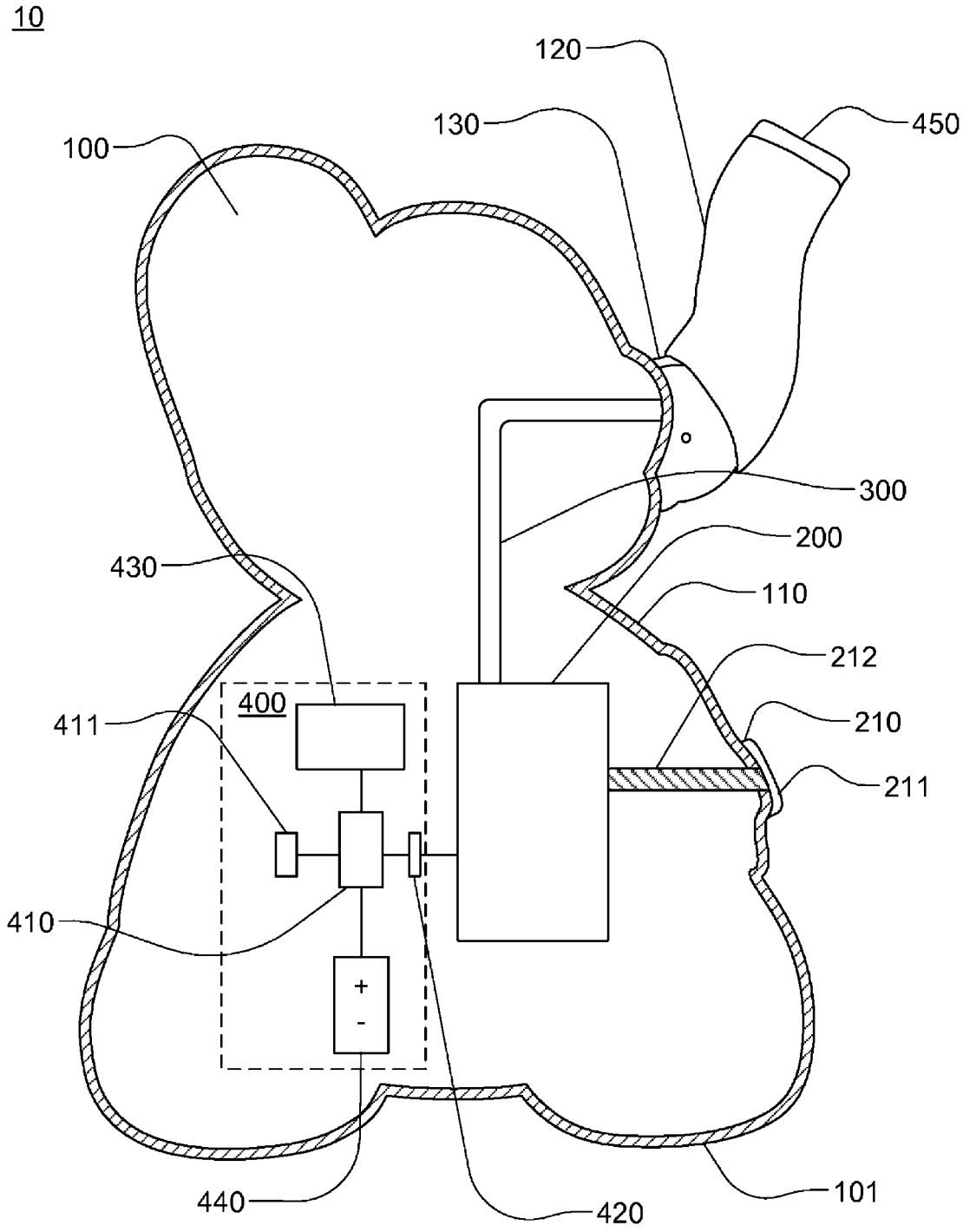
FIG. 1 is a sectional view of a preferred embodiment of the present invention with parts broken away.

With reference to FIG. 1, an embodiment of the children's learning device 10 of the present invention includes housing 100, countdown timer 200, driving mechanism 300, and electrical assembly 400.

Housing 100 primarily comprises a main body 110 and an appendage 120. In the embodiment shown in FIG. 1, the main body 110 is the shape of an elephant's torso and head, while appendage 120 is in the shape of an elephant's trunk. However, it is understood that other shapes such as animals or cartoon characters having appeal to children may be used in place of an elephant. For example, a monkey and monkey arm would also be suitable shapes for the main body and appendage. The housing is preferably molded plastic, but other natural or synthetic materials suitable for close contact with children may be employed as well.

Housing 100 preferably also includes a base 101 having a flat surface or surfaces, legs, or a combination thereof to allow learning device 10 to be stably arranged in an upright position on a flat surface. In preferred embodiments, base 101 is integrally formed with housing 100. However, it is also contemplated that base 101 may be attached to housing 100 by screws, rivets, adhesives, a friction fit, an interlocking portion, or another suitable manner.

Figure 3:
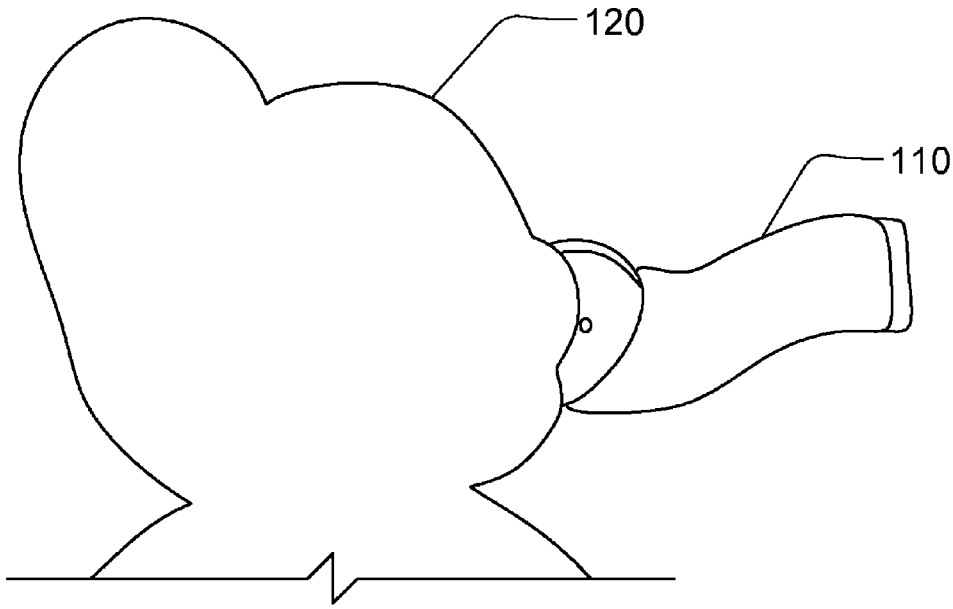
FIG. 3 is perspective view of a preferred embodiment of the present invention with the appendage in a second orientation.

In preferred embodiments of the present invention, appendage 120 is attached to main body 110 at a joint 130, allowing appendage 120 to pivot between a first and second orientation. Preferably, the appendage 120 is raised relative to the base in the first orientation and lowered relative to the base in the second orientation, as shown in FIGS. 1 and 3. Joint 130 may include a pivot pin, a ball bearing, or other suitable mechanism for allowing appendage 120 to rotate or otherwise move between the first and second orientations.

A cavity 102 is formed in housing 100. Cavity 102 may include one or more hollow compartments in which the countdown timer 200, driving mechanism 300, and electrical assembly 400 are enclosed. However, in other embodiments of the invention, one or more of these elements or portions thereof may be externally attached to housing 100.

Figure 2:
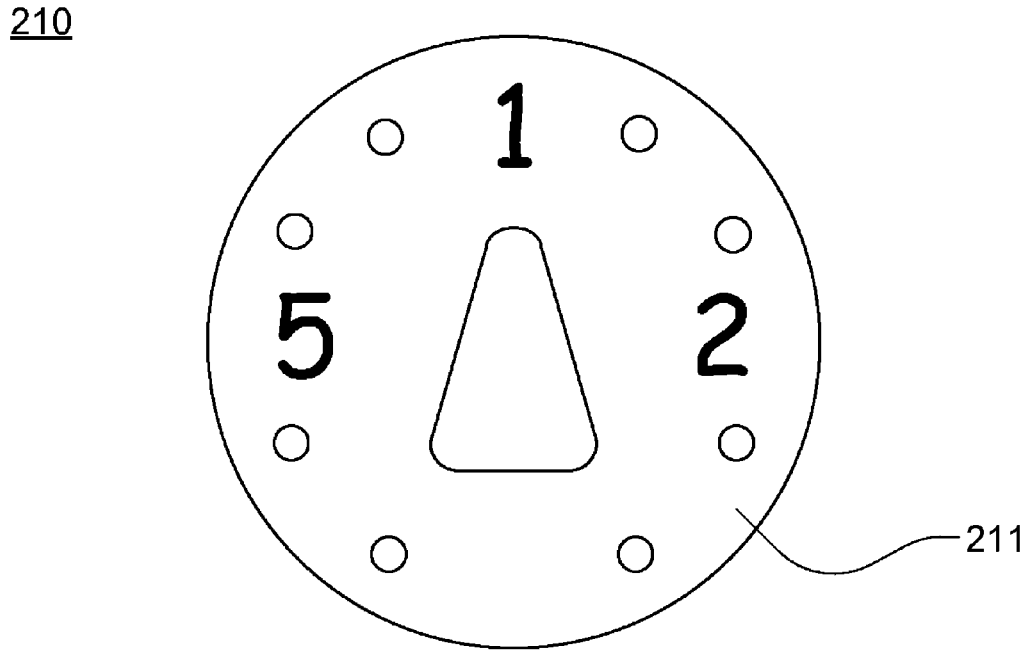
FIG. 2 is a plan view of a control dial.

In one preferred embodiment of the present invention, countdown timer 200 comprises a mechanical spring winding timer that is manually set and then unwinds in a specified time period. In another preferred embodiment, countdown timer 200 comprises a digital timer operating in conjunction with an electrical gear motor such that the motor is activated for a specified time period. Preferably, countdown timer 200 is adjustable between a plurality of predetermined countdown time periods. In this case, a control mechanism 210 is provided to allow the user to designate one of the predetermined time periods. In the embodiment shown in FIGS. 1 and 2, control mechanism 210 includes a dial 211 mechanically connected to countdown timer 200 by shaft 212. Dial 211 includes indicia representing three time periods (i.e., 1, 2 and 5 minutes) and is arranged externally on main body 110. Other mechanisms as are well known in the art may be used in place of the dial. For example, in embodiments of the present invention in which a digital timer is used, buttons or other inputs may be used to set the desired time period. Furthermore, it is understood that that the number of time periods are not limited to three. In addition, other indicia may be used to represent various time periods.

Driving mechanism 300 is connected between appendage 120 and countdown timer 200. In embodiments of the present invention in which the countdown timer comprises a mechanical timer, countdown timer 200 and driving mechanism 300 together form a clockwork for setting of the timer by manual depression of the appendage from the first (raised) orientation to the second (lowered) orientation and for driving appendage back to the first orientation from the second orientation over the course of the designated countdown time period by mechanical force provided by the unwinding of the countdown timer. On the other hand, in other embodiments of the present invention in which countdown timer 200 comprises a digital timer operating together with an electrical geared motor, driving mechanism 300 is configured to set the digital timer by manual depression of the appendage from the first orientation to the second orientation and to drive appendage back to the first orientation from the second orientation over the course of the countdown time period by mechanical force provided by the electrical motor.

It is understood that in other embodiments of the invention, driving mechanism 300 may be configured so that raising the appendage sets the countdown timer, while the unwinding of the countdown timer drives the appendage to a lowered position. In the preferred embodiment, however, the timer is set by depression of appendage 120, an operation that is easily performed young children. The passage of time is marked by appendage 120 rising in the air, providing a visual cue to educate children regarding elapsed time. When appendage 120 reaches the top, the allotted time (i.e., 1, 2 or 5 minutes) is up.

Electrical assembly 400 includes sound chip 410, switch assembly 420, speaker 430, and power supply 440. Sound chip 410 is preferably an integrated circuit, but may also comprise discrete electronic components connected so as to be capable of functioning as described below. The switch assembly 420 is connected between countdown timer 200 and sound chip 410 so as to activate the sound chip to output audio content stored in a memory 411 via speaker 430 during the unwinding of the countdown timer. Through holes (not shown) may be provided in housing 100 in the vicinity of speaker 430.

Preferably, sound chip 410 and switch assembly 420 are configured to begin audio output on release of appendage 120 at the second orientation (i.e., on the setting countdown timer 200), and cease audio output when appendage 120 is driven back to the first orientation (i.e., on the full unwinding of countdown timer 200). The audio content is preferably a song or songs with educational lyrics, for example, about the operation of the timer and the merits of sharing, encouraging users to sing along. The memory preferably also stores voice data corresponding to a termination message for output at the conclusion of the countdown time period. For example, the learning device may announce, "It's your turn now!" when the appendage returns to the first orientation.

Power supply 440 is preferably one or more batteries. In other embodiments, however, power supply 440 may be means for connecting with an external source of electrical power, such as a power converter and a connected plug or socket. Power supply is electrically connected to sound chip 410, memory 411, and speaker 430 by suitable contacts and wiring (not shown). In embodiments of the invention in which countdown timer 200 includes a digital timer and electrical geared motor, the power supply 440 may also supply power to these elements. In the case that batteries are employed as the power supply, a removable cover (not shown) may be provided in housing 100 to enable replacement of the batteries.

Memory 411 may be registers integrated with sound chip 410 or a separate memory device, such as a flash memory, and stores digital data to be converted into analog signals corresponding to one or more songs or messages by sound chip 410 and outputted by speaker 430.

In a most preferred embodiment of the present invention, a light-emitting device 450, such as a light-emitting diode, is arranged at a distal end of appendage 120 away from main body 110. A switch assembly (not shown) is configured to activate light-emitting device 450 when appendage 120 returns to the first orientation from the second orientation so as to provide an additional visual cue indicating the conclusion of the countdown time period. Light-emitting device 450 is preferably electrically connected to power source 440 by means of electric wires (not shown), but may also be powered by an independent power supply.

Embodiments of the invention may also include an on/off switch, a mute setting in which no audio is outputted, a no-song setting in which only the announcement at the conclusion of the allotted countdown time period is outputted, and/or a volume control. As the structure and operation of these elements are well known in the art, a detailed description is omitted here.

While the invention has been described by way of example and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A child's learning device comprising:

a housing comprising a base, a main body supported by the base in an upright position, and an appendage attached to the main body, wherein the appendage is connected to the main body at a joint end and extends away from the main body longitudinally to a distal end, such that the distal end is further from the main body than the joint end, and wherein the appendage pivots between a first orientation and a second orientation in which the distal end is raised or lowered relative to the upright position;

a countdown timer comprising a control mechanism for designating one of a plurality of predetermined time periods; and a driving mechanism connected between the countdown timer and the appendage, wherein the driving mechanism and countdown timer are configured such that manually pivoting the appendage from the first orientation to the second orientation sets the countdown timer for the designated time period, and the appendage is driven back from the second orientation to the first orientation over the course of the designated time period by mechanical force provided by countdown timer to the driving mechanism.

2. The learning device recited in claim 1, wherein the countdown timer comprises a mechanical timer configured such that unwinding of the mechanical timer applies mechanical force to the driving mechanism to drive the appendage from the second orientation to the first orientation.

3. The learning device recited in claim 1, wherein the countdown timer comprises a digital timer operating together with an electrical geared motor, and the electrical geared motor is configured to apply mechanical force to the driving mechanism to drive the appendage from the second orientation to the first orientation.

4. The learning device recited in claim 1, further comprising:

a sound chip;

a speaker; and a switch assembly connected to the countdown timer, wherein the switch assembly is configured to activate the sound chip to output audio content via the speaker during the unwinding of the countdown timer.

5. The learning device recited in claim 4, further comprising a memory in which the audio content is stored.

6. The learning device as recited in claim 5, wherein the audio content includes a song about sharing.

7. The learning device as recited in claim 6, wherein the audio content further includes a termination message, and the switch assembly is further configured to output the termination message when the appendage returns to the first orientation from the second orientation.

8. The learning device recited in claim 1, further comprising a light-emitting device disposed at a distal end of the appendage.

9. The learning device recited in claim 8, wherein the light-emitting device is configured to be activated by the return of the appendage to the first orientation from the second orientation.

10. The learning device recited in claim 1, wherein the first orientation is raised and the second orientation is lowered relative to the upright position.

11. The learning device recited in claim 1, wherein the main body has the shape of an animal, and the appendage has the shape of an animal appendage.

12. The learning device recited in claim 1, wherein the main body has the shape of a cartoon character.

13. The learning device recited in claim 1, wherein the first orientation is lowered and the second orientation is raised relative to the upright position.

14. A child's learning device comprising:

a housing comprising a main body and an appendage, wherein the main body comprises a base, the appendage is connected to the main body at a joint end and extends away from the main body longitudinally to a distal end, such that the distal end is further from the main body than the joint end, and the appendage is attached to the base portion in a manner so as to pivot between a raised orientation and a lowered orientation relative to the base;

a countdown timer comprising a control mechanism for designating one of a plurality of predetermined time periods;

a driving mechanism connected between the countdown timer and the appendage, wherein the driving mechanism and countdown timer are configured such that manually pivoting the appendage from the raised orientation to the lowered orientation sets the countdown timer for the designated time period, and the appendage is driven back from the lowered orientation to the raised orientation over the course of the designated time period by mechanical force provided by countdown timer to the driving mechanism;

a light-emitting device disposed at a distal end of the appendage, wherein the light-emitting device is configured to be activated by the return of the appendage from the lowered orientation to the raised orientation; and a sound chip, a speaker, and a switch assembly connected to the countdown timer, wherein the switch assembly activates the sound chip to output audio content via the speaker during the unwinding of the countdown timer.

15. The learning device recited in claim 14, wherein the countdown timer comprises a mechanical timer configured such that unwinding of the mechanical timer applies mechanical force to the driving mechanism to drive the appendage from the second orientation to the first orientation.

16. The learning device recited in claim 14, wherein the countdown timer comprises a digital timer operating together with an electrical geared motor, and the electrical geared motor is configured to apply mechanical force to the driving mechanism to drive the appendage from the second orientation to the first orientation.

17. The learning device recited in claim 14, further comprising a memory in which the audio content is stored.

18. The learning device as recited in claim 17, wherein the audio content includes a song about sharing.

19. The learning device as recited in claim 18, wherein the audio content further includes a termination message, and the switch assembly is further configured to output the termination message when the appendage returns to the first orientation from the second orientation.

20. The learning device is claim 14, wherein the main body has the shape of an animal, and the appendage has the shape of an animal appendage.

21. The learning device recited in claim 14, wherein the main body has the shape of a cartoon character.

* * * * *